US005284534A

United States Patent [19]

Mendes

[11] Patent Number: 5,284,534

[45] Date of Patent: Feb. 8, 1994

[54] THERMOMECHANICAL METHODS FOR IMPROVING THE FATIGUE CHARACTERISTICS OF METALLIC MATERIALS

[76] Inventor: Carlos A. T. Mendes, Rua Nicolau Barreto #287, Sao Paulo, Sao Paulo, Brazil, CEP 04583

[21] Appl. No.: 790,661

[22] Filed: Nov. 8, 1991

[51] Int. Cl.[5] ..... C21D 8/06

[52] U.S. Cl. ..... 148/595; 148/598; 148/599; 148/645; 148/648; 148/650

[58] Field of Search ..... 148/11.5 R, 12 R, 12 B, 148/12 F, 645, 578, 595, 598, 599, 648, 650

[56] References Cited

U.S. PATENT DOCUMENTS 4,544,610 10/1985 Okamoto et al. ..... 428/611
4,915,900 4/1990 Nomura et al. ..... 420/84

FOREIGN PATENT DOCUMENTS 61-56235 3/1986 Japan ..... 148/645
451796 11/1974 U.S.S.R. ..... 148/645
8902936 4/1989 World Int. Prop. O. ..... 148/645

*Primary Examiner*—R. Dean
*Assistant Examiner*—Sikyin Ip
*Attorney, Agent, or Firm*—Hale and Dorr

[57] ABSTRACT

A thermomechanical method for improving the fatigue characteristics of a metallic material (for example carbon steel and low alloy steel) takes advantage of the materials' plastic flow characteristics to improve external and internal surface conditions. The material is heated to a temperature in the range of about 0.3 to 0.45 its homologous temperature, e.g., from about 200 degrees C to about the Young's Modulus Transition Temperature of said material. While the temperature of the material is in this range, force is applied to the material to produce in at least the region of said material to be treated a tensile stress level greater than the yield point of said material at the temperature, and thereby to produce limited plastic elongation in the region. The material is then cooled under stress, the stress being maintained above the instantaneous yield point of the material during at least part of the cooling process. As a result of this process, the shape of existing stress raisers (e.g., radii at the base of cracks and flaws) are changed in ways which lower stress concentration factors in the material.

20 Claims, 3 Drawing Sheets

THERMOMECHANICAL METHODS FOR IMPROVING THE FATIGUE CHARACTERISTICS OF METALLIC MATERIALS

BACKGROUND OF THE INVENTION

The present invention relates to thermomechanical methods for improving the fatigue strength and corrosion fatigue resistance of metallic materials (e.g., carbon steel and other steels), particularly components (e.g., sucker rods) made from such materials.

Fatigue strength is traditionally thought of as that stress that a metallic material may support for the time it takes for a fatigue crack to develop at the outer surface of the material and propagate to a depth where the material no longer can support the applied loads. Fatigue strength is usually related to the surface condition of the material. External surface defects such as scratches, nicks, superficial cracks due to heat treatment and other defects result in crack-like stress raisers and act as initiation sites for fatigue. Internal surface defects, including inclusions, behave as stress raisers in the body of the material. Corrosive media also have a strong deleterious effect on the fatigue life of metallic materials through either direct corrosion and/or hydrogen embrittlement mechanisms. This phenomenon is commonly referred to as "corrosion fatigue." Increasing the temperature directly increases the aggressiveness of the corrosive activity.

There are well-known processes which rely on mechanical action to improve the fatigue strength of metallic materials and permit them to be used in parts which are severely stressed during service. One such technique reduces the depth of, or completely eliminates, stress raisers on the outer surface of the material by grinding and/or polishing. This decreases the t/r ratio (depth of discontinuity/radius of curvature of the base) of existing cracks by decreasing the depth of the notches and discontinuities. As a result, the stress concentration factors decrease and fatigue strength of the metallic material is increased.

Studies have shown that crack propagation occurs at the outer surface of the part and propagates normal to the direction of the applied principal stresses. A tensile component in the principle alternating stress system is a necessary condition for fatigue. Thus, the fatigue strength of a part can be improved by creating a region of residual compressive stresses in the surface of the part, thereby eliminating or reducing tensile stresses. Three common methods of inducing compressive stresses in the surface of a material are (1) heat treatment by quenching, (2) chemical additions to the surface and immediate subsurface regions which tend to expand the volume of those regions, and (3) impact on the surface resulting in principal compressive stresses therein. However, none of these methods change the t/r ratio of existing surface discontinuities. They merely prestress the surface of the part in compression so that fatigue will not occur unless the applied alternating tensile stress is sufficiently higher than the existing residual compressive stress built into the part by the process.

The impact treatment of the part's surface will reduce the number of surface discontinuities and introduce beneficial compressive stresses at the surface. Both rolling of shafts and shot peening the surface produce the same general characteristics as impact treatment. However, shot peening does not work on all metal materials and it is quite difficult to control.

Most, if not all, of the conventional methods for reducing fatigue have the following characteristics in common: (1) the effects are restricted to the external surface of the part and to a thin layer immediately below, (2) the volume of material affected is small and the beneficial effects are restricted to discontinuities and notches in the region of the external surface, and (3) the radii of curvature of the notches at the base of the discontinuity remain unchanged.

Conventional treatments of metallic materials to increase fatigue strength also are characterized by the disadvantages that the methods have to be varied for each material depending on its intrinsic characteristics (i.e., melting temperature or transformation point), and that they provide only limited benefit in terms of preventing corrosion fatigue.

An object of the present invention is to provide a process for improving the fatigue characteristics of materials, which is particularly suitable for use on any metallic material and which affects substantially the entire volume of the material subject to fatigue.

Another object is to provide a process for increasing both the mechanical fatigue strength and the corrosion fatigue resistance of metallic materials.

SUMMARY OF THE INVENTION

The thermomechanical process of the present invention takes advantage of the plastic flow characteristics of a metallic material (e.g. carbon steel) to improve its internal and external surface condition, and thereby improve both the fatigue strength and the corrosion fatigue resistance. The process affects the shape of existing stress raisers (such as cracks, flaws, voids and inclusions), causing material adjacent the bases of the cracks and flaws to flow in a plastic state, and thus changing the shape of existing stress raisers and lowering stress concentration factors.

In particular, the method involves (1) heating the material to a temperature in the range of about 0.35 to 0.65 (preferably about 0.5) of the homologous temperature of the material, a temperature typically in the range about 200 degrees C to about the Young's Modulus Transition Temperature; (2) while the temperature of the material is in this range, applying a force system to the material to produce in at least the region of the material to be treated a tensile stress level greater than the proportional limit and, typically, greater than the yield point (which for practical reasons is often defined as the stress corresponding to a permanent strain of about 0.2%) to cause plastic deformation in the region; and (3) then cooling the material under stress, the stress being maintained above the instantaneous yield point of the material during at least part of the cooling phase. As a result of this process, the permanent plastic strain in the region to be treated, typically in the range of about 0.05% to 1.0%, changes the shape of existing stress raisers (e.g., the radii at the base of cracks and flaws) and lowers stress concentration factors in the material.

In preferred practices of the invention, the material is heated to about 90% of the Young's Modulus Transition Temperature, the force system is chosen to produce a stress in the region greater than that at the proportional limit but not more than the stress that, at the particular temperature, corresponds to an additional strain in the range of about 5% to 50% (and, for most materials, preferably about 10%) of, and above, the plastic strain at the yield point, and the material is cooled to a temperature of about 200° C. while continuing to apply force thereto. The application of the force system both at the particular temperature and during cooling results in an overall permanent strain that, preferably, is about twice the permanent strain at the yield point, or about 0.4%.

These and other aspects, objects and advantages of the present invention will become apparent from the following detailed description, particularly when taken in conjunction with the accompanying drawings.

DESCRIPTION OF PREFERRED EMBODIMENTS

Figure 1:
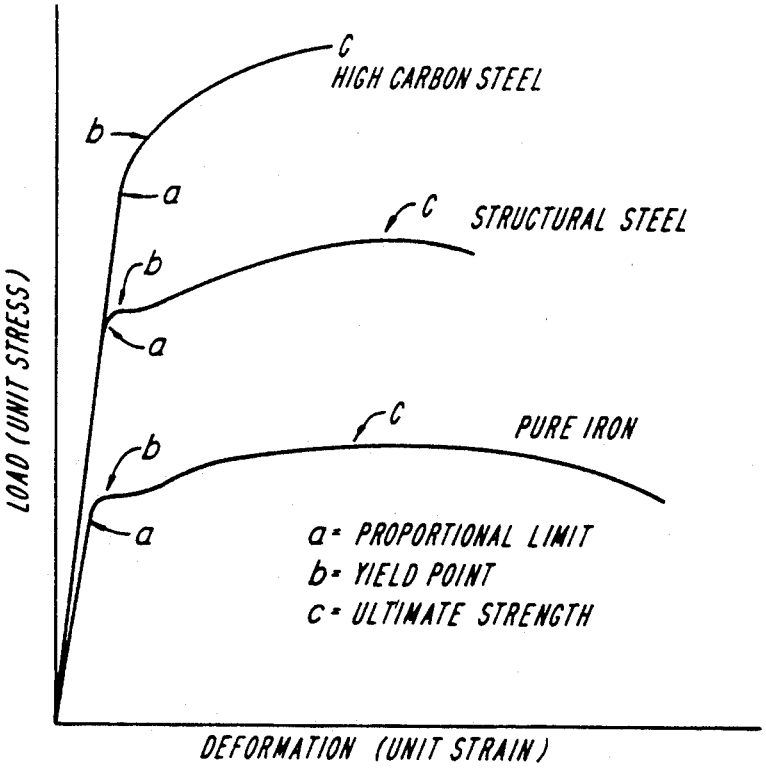
FIG. 1 shows typical stress-strain curves for three typical types of iron or steel.

When a metallic material is placed under a tensile load, the material elongates; the amount of elongation increases with increasing load or stress. Initially, the elongation is directly proportional to load; the point at which this ceases to be so is known as the proportional limit, and is indicated at "a" in FIG. 1. The elastic limit is the greatest load that may be applied after which a material will return to its unstrained condition, and for all practical purposes is usually substantially the same as the proportional limit. The yield point, indicated at "b" in FIG. 1, is the stress at which a material will continue to elongate even though the load is not being significantly increased. In many materials, the yield point is not well-defined, and it is consequently common practice to define the yield point (or yield stress) as the stress corresponding to a specific amount (typically 0.2%) of permanent strain.

The stress-strain curves of metallic materials change with temperature, i.e., the elastic modulus, the proportional and elastic limits, and the yield point all decrease, with increasing temperature.

The moduli of elasticity of metallic materials both in tensile stress (Young's modulus (E)) and in shear (often referred to as the modulus of rigidity, ("G") of metallic material also vary with temperature. As material temperature rises, e.g., from room temperature, both moduli typically remain relatively constant (they often decrease slightly with increasing temperature, but at a relatively slow rate) until the homologous temperature (i.e., the ratio of the ambient temperature to melting temperature of the materials, both temperatures being measured in degrees Kelvin) is in the range of about 0.35 to 0.65 (for many irons and steels this is in the range of about 400° C. to about 600° C.). Thereafter, the moduli decrease relatively quickly as the temperature continues to increase. The "point" at which each modulus begins to decrease significantly with increasing temperature is referred to herein as the respective Modulus Transition Temperature (the "MT Temperature"); for Young's Modulus, it is referred to as the "YMT Temperature". In most materials, as would be expected, the Modulus Transition Temperature is not a sharp "point"; rather there is a region (the "knee") over which, with increasing temperature, the shape of the modulus vs. temperature curve changes from generally horizontal to steeply sloped. Under circumstances of this type, the MT Temperature is the point of intersection of two straight lines tangent to the curve, one on either side of the curve. For the purpose of this patent application, the MT Temperature of materials are measured in degrees F or C.

Figure 2:
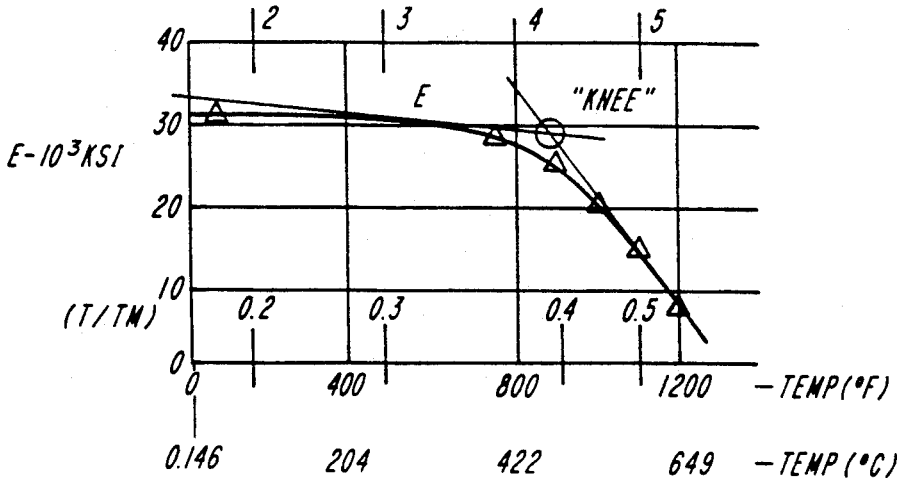
FIG. 2 is a graph showing, for a 4140 type steel rod, changes in the modulus of elasticity (Young's modulus) with temperature.

With reference to FIG. 2, which is a graph of Young's modulus of elasticity (E) vs. temperature (T) for a typical 4140 steel, the MT Temperature is at the intersection of lines 4 and 6, or about 470° C. The graph of FIG. 2 is taken from a standard commercial specification sheet for 4140 steel. Typically, the location of the "knee" indicated on such standard specifications is quite accurate, but it is nonetheless often desirable to more accurately determine the MT temperature by repeated tests of the particular material to be treated. The preferred practice of the present invention is to heat the material being treated to a temperature near, but slightly (e.g., about 10%) below, the Modulus Transition Temperature corresponding to the stress system to which the material is subjected. The process can be practiced at higher temperatures, but control becomes more difficult.

Figure 3:
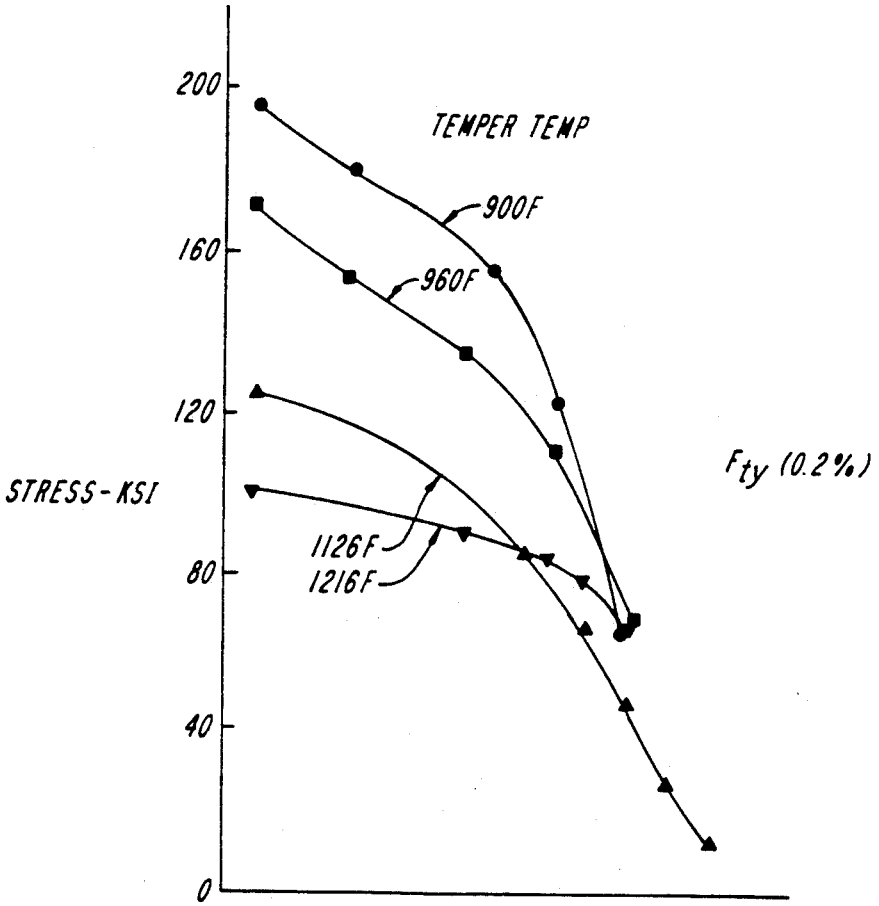
FIG. 3 is a graph showing change in yield strength with temperature for a 4140 steel rod.

FIG. 3, also taken from a standard specification sheet for 4140 type steel, illustrates the manner in which the yield point of a metallic material typically decreases with increasing temperature. As shown, the yield point (in FIG. 3 the stress that results in 0.2% permanent deformation) is affected by the manner in which the material was tempered. For a typical 4140 steel tempered at 1125° F. (about 600° C.), the yield point is about 125,000 psi at room temperature, and about 80,000 psi at a temperature about 10% below Young's Modulus Transition Temperature.

According to the present invention, the material to be treated is subjected to a controlled stress to geometrically modify discontinuities (e.g., cracks) at external or internal surfaces of the material in such a way as to minimize the initiation of fatigue cracks. As used herein, the term "surface" refers to both the external boundaries of a material, and to boundaries and/or interfaces of voids, inclusions and metallic crystals or grains internal to the material. The process takes advantage of geometric changes; and can be used to improve the fatigue characteristics of any material that has plastic flow characteristics.

The plastic flow, at least on a microscopic scale at the bases of cracks and notches, increases the radii of curvature at the bottom of the surface discontinuities because they are located in regions where stresses are the greatest when the material is subjected to an applied force system.

According to the preferred practice, the process of the present invention subjects metallic material to controlled tensile stress. Before a force system producing tensile principal stresses is applied to it, the metallic material is heated to a predetermined "flow temperature", typically above 300° C. but below the Young's Modulus Transformation Temperature, both to avoid brittle cracking and to reduce the external load necessary to cause the desired plastic flow.

With reference to FIG. 2, the "flow temperature" typically is about 90% of the YMT Temperature. Such a flow temperature is high enough to insure that the yield strength of the material is significantly less than at room temperature and reduces the likelihood of brittle cracking. However, it is also sufficiently below the YMT Temperature so that, even when the Young's modulus is not well defined, the material is in a region (see FIG. 2) in which relatively small temperature changes will not result in large changes in the Young's Modulus (E). Based on the standard specification sheet from which FIG. 2 was taken, the YMT Temperature of 4140 steel is about 470° C. (about 880° F.), and the flow temperature initially chosen is about 425° C. (about 800° F.).

As previously indicated, the initial "flow temperature" should be checked against trial results, independent of what is shown in standard specifications, to insure that the temperature chosen will not induce undesirable metallurgical effects such as, for example, transformation changes. If undesirable metallurgical changes are noted, the flow temperature should be decreased to avoid them.

The load to be applied to the material is determined on the basis of the chosen "flow temperature". The goal is to apply a loading system of forces that, in at least the region of the material to be treated, will result in a tensile stress equivalent to (or slightly greater than) the yield strength (at the "flow temperature") of a uniaxially loaded bar of the material.

As indicated in FIG. 3, the 0.2% yield strength of 4140 steel tempered at 1125° F. (about 600° C.) varies with temperature. At the Young's Modulus Transition Temperature (about 470° C.) it is about 70,000 psi; at 425° C. (about 90% of the Young's Modulus Transition Temperature) it is almost 80,000 psi. Thus, if the material is treated at a flow temperature of about 425° C., the force system chosen would, desirably, produce a tensile stress of a little over 80,000 psi in the area to be treated. Such a stress typically is sufficient to insure plastic flow at the bottom of cracks and similar stress raisers, usually in the direction of the principal tensile stress, and at the same time is low enough to avoid brittle fracture and too rapidly accelerating plastic deformation.

As should be apparent, the stress that causes plastic flow at the bottom of a stress raiser may be the result of the external "action of any system of generalized forces (e.g., a uniaxial force, a couple, or a wrench, e.g., both a uniaxial force and a couple" is chosen to satisfy the geometry of a part. When the stress configuration resulting from the applied force system approaches a pure shear geometry, then initial plastic flow typically will result from shear stress rather than from principal tensile stresses. Under these circumstances, the flow temperature should initially be chosen based on the modulus of elasticity in shear (modulus of rigidity) as a function of temperature rather than simply on Young's Modulus (E), and the temperature on the basis of the Modulus Transition Temperature of the shear modulus; and the stress system should be chosen to produce a shear stress that corresponds to a strain of about 10% above the strain at the shear yield point.

In any event, after the chosen force system has been applied to the material to be treated, the material is then cooled while the force system is maintained. The force itself, the length of time during which force in excess of the yield strength is applied, and the total permitted elongation of the material must be selected in such a way as to insure that the desired plastic flow has occurred at the bases of the stress raisers, and also to insure that there has been no "necking down" or other localized reduction in the material cross-section. In other words, there must be some, but not excessive, plastic strain in at least the portion of the material being treated.

In practice, the necessary control is provided by determining the maximum permitted and minimum desired elongation of the material being treated, and adjusting the applied force and monitoring the material elongation. Since the material is subjected to stress while at elevated, but substantially constant temperature, the elongation resulting from the applied stress has two principal components: elastic strain and plastic strain.

At any temperature, the elastic strain of a material at about the yield point can be calculated using Young's Modulus. Based on the value given in the standard specification sheet from which FIG. 2 is taken, the elastic strain of 4140 steel at the yield point is about 0.3%.

The amount of plastic strain to be produced has both upper and lower limits. The lower limit is the amount of plastic strain required to insure the desired plastic flow at the bases of the stress raisers; as little as about 0.05% may be sufficient, but material variations and difficulties in measurement make the deformation at the yield point, about 0.2% the practical lower limit. The upper limit must be low enough to avoid loss of cross-section and initiation of new cracking; here, again, the exact limit can be experimentally determined but, as a practical matter, should not exceed about 1%. In the typical practice of the invention, the desired total plastic strain is about 0.3% to 0.5%, usually about 0.4%, i.e., about twice the plastic strain at the yield point.

The level of force applied to the material to produce the desired strain is also subject to some experimentation. Typically, the force system is chosen to produce an applied stress level in the portion of the material to be treated that is (i) greater than the yield point of the material at the temperature at which the force is initially applied, but (ii) not more than the stress that, at the particular temperature, corresponds to a strain of about 10% more than the strain at the yield point. For example, if the material is treated at 450° C. and at that temperature has a yield point (typically defined in standard specifications as the point at which 0.2% permanent elongation has occurred) of 80,000 psi, the force system would be chosen to produce a stress greater than 80,000 not more than that required to produce an additional 0.02% elongation or strain. The increased stress required to produce the 0.02% elongation above the strain at the yield point can also be calculated using Young's Modulus (E); e.g., increased stress-=(E)(0.0002). A principal reason for not choosing a force system that would produce a greater stress is to avoid too rapid acceleration of the elongation phenomenon when stress is applied, and to avoid introducing brittle fracture.

In practicing the invention, thus, increasing force is applied to the portion of the material to be treated until either the desired tensile stress level or the desired plastic strain level is reached. Preferably, the force level has been first determined (e.g., by preliminary experimentation), so that the desired tensile stress is reached at a time when the elongation of the material has exceeded the minimum necessary to achieve the desired plastic deformation but has not reached the upper strain limit.

When the force being applied to the material has resulted in the desired level of principal stress, or has caused the maximum desired plastic strain, the material is cooled, typically in a controlled but relatively rapid manner and to a temperature of not over about 200° C. (about 400° F.). Typically, the maximum level of permitted applied force is held approximately constant during cooling. If sufficient controls are available, the applied force may be adjusted as the material cools(e.g., increased as the yield point increases with decreasing temperature) so that the stress within the material will remain above the instantaneous yield point (i.e., the yield point existing at the temperature of the material at a particular instant) during cooling. In practice, even when a system seems to maintain an approximately constant force during cooling, the actual stress tends to increase as the material contracts and then to be brought down to the desired level by the force control system. In either event, the stress will be above the yield point during at least some of the cooling process. It will be noted, however, that the yield strength of the material at the end of the cooling process typically is much greater than at the temperature at which cooling commenced; and at some point during the cooling process the yield point will typically increase to a level that is greater than the tensile stress produced by the applied force system.

Maintaining the applied force system such as to keep the applied stress in the portion of the material being treated above the instantaneous yield point during at least part of the cooling process insures the desired plastic deformation, especially at the bottom of existing notches and discontinuities. However, the force must not be so high as to cause new cracks or to induce brittle behavior.

At any point in time, the total elongation of the material from its room-temperature, pre-processing, unstressed state has three principle components: thermal expansion, elastic strain, and plastic strain. The amount of thermal expansion at any particular temperature can be calculated, and the total thermal expansion will decrease as the material cools. Elastic strain also can be calculated using Young's Modulus and the value of either the applied stress or (approximately) the yield point. The total elastic strain will typically slightly decrease during cooling; the applied stress is substantially constant and cooling takes place in the range (see FIG. 2) in which Young's modulus increases only slowly with decreasing temperature.

The applied force system is released when the total deformation of the material reaches an amount equal to the sum of (a) the deformation resulting from predetermined desired plastic strain, (b) the thermal expansion at the cooled temperature, and (c) the elastic deformation produced by the applied force at the cooled temperature. The decrease in deformation from the point at which cooling started is due principally to thermal contraction and to a lesser degree to decreased elastic strain.

After the force/stress is released, the metallic material is further cooled to room temperature, preferably by immersing the material in a liquid (for example, water) bath.

The process of this invention offers a number of advantages over conventional techniques. It affects the entire volume of at least the portion of the material desired to be treated not just the external surface and immediate subsurface; and the number of discontinuities affected by this process is greater by a factor of the ratio of any characteristic dimension (for example, h/d, which h is the depth below the surface affected by a current process, and d is the diameter of a cylindrical part). Thus, far more existing stress raisers which could initiate fatigue failure are treated than is possible using any conventional process.

Also, this process increases the radii of curvature at the bottom of the surface discontinuities (thus increasing the t/r ratio) because they are located at regions where stresses are the greatest when subjected to an external tensile stress, and by maintaining a tensile stress above the elastic limit insures that the material will deform plastically and increase the radius at the bottom of each individual notch at those places of highest stress.

In addition, because the process of this invention results in minimum residual stresses in the metallic material, treatments which induce beneficial surface compressive stresses may still be used to further increase fatigue resistance.

As a result of these advantages, the fatigue characteristics of the material are substantially improved. Equally important, the allowable stress-to-weight ratio of products subject to fatigue is materially increased, thereby allowing substantial reduction in weight of products that must provide a particular design safety factor.

The invention is illustrated further by the following exemplification, which is not to be taken as limiting in any way.

Exemplification

The process of this invention was carried out on SAE 4140 type steel rods one inch in diameter and 315 inches (8 meters) in length. To eliminate residual stresses and also to insure that the yield strength vs. temperature characteristics (FIG. 2) would closely approximate one of the curves set forth on an available standard specification sheet, the rods were normalized by heating for one hour at 1125° F. (600° C.) in a horizontal furnace having a nitrogen atmosphere. This normalization step does not affect the subsequent treatment process and may be omitted if the yield strength vs. temperature characteristics of the material are known.

The rods were then removed from the furnace, were permitted to cool in air to about 427° C. (about 800° F.), i.e., a little over 90% of the material's Young's Modulus Transition Temperature while being placed in a horizontal hydraulic press, and were then subjected to tensile force.

The force was applied by engaging one end of the rod with a pair of jaws which were in turn connected to a hydraulic cylinder, and applying hydraulic fluid under pressure to the cylinder in such a way as to move the jaws axially with respect to the rod, the point at which the jaws initially engaged a collet adjacent one end of the rod (at which point force began to be applied to the rod) was noted and the axial force was applied until either the applied force or total rod elongation reached a predetermined level.

In the force-applying process in the press, both the amount of applied stress and the amount of rod elongation were controlled. The force control was set to limit the applied force to a level that would produce, in the rod, a tensile stress of $84\times10^3$ psi. This total stress is $5\text{-}6\times10^3$ psi above the yield point and, based on Young's Modulus calculations, produce a plastic strain greater than about 10% of that strain at the yield point (a little over $78\times10^3$ psi) of the 4140 steel at 427° C. (800° F.). Since the rod diameter was one inch, the maximum permitted applied force was about $66\times10^3$ pounds ($30\times10^3$ kg).

The maximum amount of plastic elongation to be permitted in the press was determined to be about 0.4% (i.e., about twice the 0.2% yield point deformation) of the rod's original 315 inch (8 meter) length. The elastic elongation resulting from the to-be-applied $84\times10^3$ psi stress, was calculated, again using Young's Modulus at 427° C. (800° F.), and determined to be about 0.3%. Thus, the press was set to not permit a total (plastic plus elastic) strain of more than about 0.7% (the actual setting was 2.28 in. for the 315 in. long rod) during the period, before cooling, in which force was being applied.

The hydraulic system moved the jaws of the press axially. The pressure in the hydraulic cylinder, and the force applied to and the tensile stress in the rod, steadily increased. Force continued to be applied until either (i) the force applied reached the applied stress ($84\times10^3$ psi or $66\times10^3$ kg.) limit, or (ii) the maximum desired total plastic and elastic elongation under load (about 0.7%) had been achieved.

When either of these levels was reached (and in practice the dynamics of the system and level of applied force were such that the maximum desired force was reached before the maximum desired elongation had resulted), the rods were cooled by water spraying. The applied tensile stress of $84\times10^3$ psi was maintained during cooling. It should be noted, however, that if the spray cooling had been triggered by the maximum desired elongation, the applied force would first have been reduced (typically to zero) to prevent further elongation; as the rod thermally contracted, the force (up to the $84\times10^3$ psi limit) would have been reapplied.

Through experimentation it was determined that the rods retained the desired total permanent elongation (plastic deformation) of about 0.4% when cooled under stress to a temperature of about 200° C. Thus, when the temperature of the steel rods reached 200° C., the applied force, and then the jaws engaging the rods, were released. The rods were removed from the press and immersed in water to cool them to room temperature.

Figure 4:
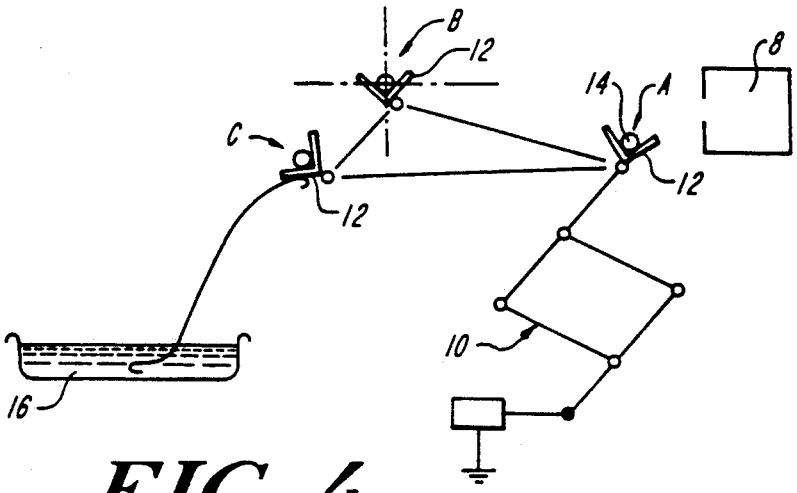
FIGS. 4 and 5 illustrate, somewhat schematically, a system used to practice the invention.
Figure 5:
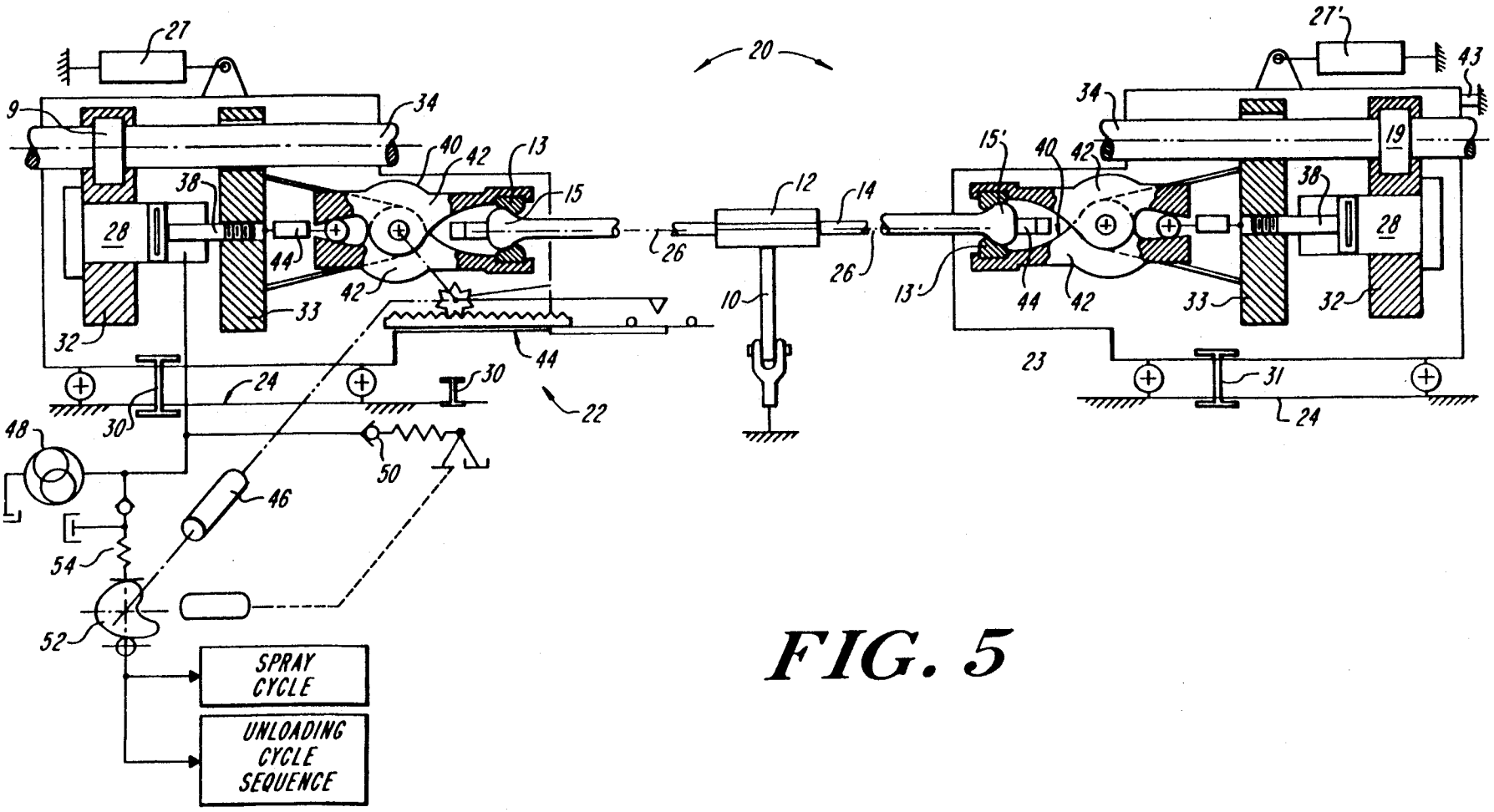

FIGS. 4 and 5 illustrate, in somewhat schematic form, a system used in the practice of the invention.

As indicated, a linkage mechanism 10 carries a number of axially aligned platens 12 which are arranged to support axially spaced portions of a rod 14 and move the rod from the exit from the furnace 8 (the position, marked "A", at which the mechanism is shown in FIG. 4) into the horizontal press (position "B" in FIG. 3 and the position illustrated in FIG. 5). After the force system has been applied to the rod and the desired plastic strain obtained, the platens 12 move the rod 14 to a discharge position (position "C" in FIG. 4) from which it is dropped into a water bath 16.

The horizontal press, generally designated 20, is shown schematically in FIG. 5. As there illustrated, it includes a pair of head assemblies 22, 23 mounted on a common base 24 for movement towards and away from each other along an axis 26. Each of the head assemblies may be displaced relative to the base 24 by positioning respective cylinders 27, 27' and may be fixed relative to the base by respective clamps schematically illustrated at 30, 31. The head assemblies are maintained in alignment by mounting plates 32, 33 on three longitudinally extending columns 34, which are mounted in their bearings so as to be free to move axially relative to the base 24 of the system. The three columns 34 are parallel and only one is shown. A jaw assembly, generally designated 40, is mounted on each forward plate 33. As shown, each assembly 40 includes a pair of pivotal jaws 42 carrying respective collets 13 and 13' and a cylinder 44 for opening and closing the jaws, and is arranged so that the collets can engage the upstanding heads 15 15' at the ends of the rods 14.

As illustrated the rear plates 32 of head assemblies 22, 23 are designed to be fixed in any desired location on columns 34 by respective locking collars 19, and carry jaw assembly cylinders 28, 29. The locking collar 19 of head assembly 23 is locked to columns 34 at the outset and remains locked throughout. The piston 38 of each of cylinders 28, 29 is attached to one of forward plates 33, and the forward plates are movable on the columns 34 to cause the jaw assemblies 40 to move relatively towards and away from each other (and relative also to the head assembly in which it is mounted) in response to movement of the pistons 38.

The typical operation of the system of FIGS. 4 and 5 is as follows. Initially, head assemblies 22, 23 are positioned in their farthest apart relative position (i.e., the pistons of cylinders 27, 27' are fully withdrawn), the jaws 42 of assemblies 40 are open, and the linkage mechanism 10 has positioned platens 12 in the loading position "A". A rod 14 is moved axially from the furnace 8 onto the platens 12, and the linkage mechanism 10 then moves the platens and rod into position "B" in which the rod 14 is generally coaxial with the axis 26.

The next step is to move head assemblies 22, 23 to position the collets 13, 13' which are fixed to the pivotal jaws 42 past the heads 15, 15' of the rods, and to close the jaws 42 over the heads 15, 15' in such a way that the collets 13, 13' will engage, but avoid marring, the rod surface. Typically, this is accomplished by causing cylinder 27' to advance head assembly 23 (with its jaws 42 open) to its forward-most position (i.e., to its left-most position as viewed in FIG. 5), and then causing cylinder 27 to advance head assembly 22 (again with its jaws 42 open) toward head assembly 23 until the jaws 42 of head assembly 22 engage the near (the left as viewed in FIG. 5) end of rod 14. Both pairs of jaws are now closed over heads 15, 15' with collets 13, 13' engaging the body of the rod. Continued motion of the head assembly 22 forces rod 14 to the right until the right end of the rod presses against a sensor at the rear of jaws 42 of head assembly 23, and causes head assembly 23 to move the right until head assembly 23 hits a control stop 43. The control stop causes locking collar 19 of head assembly 23 to lock plate 33 to columns 34 and head assembly 23 to be locked to base 24 through clamp 31, and the movement of head assembly 22 to reverse. It will be noted that, at this stage, both sets of jaws 42 and collets 13 and 13' are closed around, but do not engage the heads 15, 15' at the adjacent ends of, the rod.

Piston 27 now moves head assembly 22 in the opposite direction (to the left as shown). The initial movement of head assembly 22 brings jaws 42 and collet 13 into engagement with the head 15 at the left end of the rod and then pulls the entire rod 14 to the left until the jaws 42 and collet 13' of head assembly 23 also tightly engage the rod head 15' at the right (again as seen in FIG. 5) end of the rod 14. Platens 12 move down to avoid marring the rod as the rod straightens under tension; and they are positioned to maintain the rod coaxial with axis 26.

The movement of head 22, coupled with axial force applied to the rod 14 by the pistons 38 of cylinders 28, 29 which receive fluid under pressure from pump 48, take all "slack" out of the system. Clamps 30 and 31 and the pressure in cylinders 27 are now released, leaving the head assemblies 22, 23 and columns 34 free to move as a unit relative to base 24. Rack-and pinion monitor system 44 monitors the position of jaws 42 relative to head assembly 22, and sets the "zero" point of the rod elongation control 46.

The controlled elongation of rod 14 is effected by cylinders 28, 29. Pump 48 applies fluid, now under high pressure, to the cylinders 28, 29, moving the pistons 38 relatively apart, applying tensile stress to rod 14 and causing it to elongate. An adjustable pressure control valve 50 limits the amount of pressure applied to the cylinders so that, as previously discussed, the total force exerted axially on rod 14 will not exceed a predetermined maximum.

The amount of elongation, measured as elongation from the initial start point, is monitored by monitoring system 44 and transmitted to rod elongation control 46. Because the overall system is balanced, half of the total elongation is measured by monitoring system 44. When the total amount of elongation has reached a preset maximum, also as discussed above, rod elongation control 46 rotates control cam 52, permitting fluid control valve 54 to open and reduce the pressure applied to cylinders 28, 29, and also triggering the spray cycle to initiate water spraying onto the rod 14.

The water spray, as discussed above, causes rod 14 to contract; and cylinders 28, 29 continue to apply tensile force to the rod as it contracts. Control valves 50, 54 "float" at the set level so that pump 48 continues to maintain the predetermined maximum force during cooling.

The overall elongation of the rod is continuously monitored during cooling, still with reference to the initial start point. When, in the course of cooling, the overall elongation of the rod (as monitored by rack-and-pinion system 44 and elongation control 46) is at the desired level, elongation control again rotates control cam 52, this time to permit valves 50, 54 to open and reduce the pressure applied to the rod; and also to cause jaw assembly cylinders 44 to open jaws 40 of head assemblies 22, 23.

The linkage system 10 and platens 12 now move the rod 14 to position "C" shown in FIG. 4, and drop the rod 14 into a water bath 16.

Laboratory Tests

Static and dynamic laboratory tests were conducted on samples of normalized 4140 AISI low alloy steel from sucker rod production lines in order to analyze the effectiveness of the treatment process. The samples were divided into three groups. Each group contained samples which were 1.0, 0.75 and 0.50 inches in diameter. Group I received normalizing heat treatment; Group II received thermal heat treatment to produce surface compressive stresses; and Group III was treated in accordance with the thermomechanical process of this invention.

Static tension test results on these sizes were normalized to standard sample test dimensions.

The dynamic loading specifications for testing the sucker rods were the following:

1. A pulsator type machine was used. The load was a uniaxial tension. The load function was a pulsating sinusoidal form with minimum zero stress (pull-pull type of load). Maximum stresses were $24.2\times10^3$ psi and $32.2\times10^3$ psi. The frequency of stressing was 10 hertz. For material testing, samples were machined to standard sample geometry. For part testing, "as rolled" samples were used; only the ends were machined for attachment to the testing apparatus.
2. The alternating stress component was 50% of the maximum stress.
3. The environment was an aqueous solution of sodium chloride (0.05 to 0.5N) with gaseous $H_2S$ present.

Dynamic tests were carried out using the procedure described above.

Test Results

In the static uniaxial tensile tests, all results were in the normally expected range.

In the dynamic tests, normalized rods from Group I failed in the range of 270,000 cycles for a peak stress of 31,000 psi. The samples from Group II failed in the range of 950,000 cycles for a peak stress of 30,200 psi.

In comparison, the samples treated according to the process of this invention (Group III) did not fail at 1.7 million cycles with a peak stress of 24,200 psi. For new tests, the peak stress was increased to 32,200 psi, chloride solution to 0.5N, and gas bubbling increased. The tests were stopped at 4 and 3 million cycles with no failure occurring.

When laboratory results are reduced to a common set of conditions characterized by material composition, mode of loading, surface conditions, environment and equivalent frequency of testing, and comparisons made at an extrapolated life of 10 million cycles; results show a two-fold increase in fatigue strength over those obtained in Samples without the thermomechanical treatment described herein.

The results from samples laboratory tested in "as rolled" surface condition and at 1.7 million cycles, indicate that the strength gained in fatigue and corrosion fatigue is greater than two-fold compared to similar as-rolled samples without the thermomechanical treatment described herein.

Field Tests

Sucker rods treated according to the process of this invention also were tested under corrosive conditions in oil fields where the average life of a standard sucker rod varies from 28 to 32 days, and failure is most often caused by fatigue and corrosion fatigue. However, when rods treated according to the process of this invention were used, rod changes were required in no less than 70 days with common occurrences of 160 to 170 days. Several sucker rod lines were still performing after seven months. These results were gathered from over 500,000 rods tested in these fields.

Two hundred and fifty thousand rods treated according to the process of this invention were tested. The reports stated that sucker rod lines required changing only after 70 to 80 days of operation.

The results of these field tests confirm that rods treated according to this invention provide an increase in life of at least two-fold over that shown by untreated rods. The laboratory test results indicate that at an extrapolated life value of 10 million cycles, the fatigue strength and corrosion fatigue strength of rods treated in accordance with the process of this invention is also more than two-fold that of untreated rods.

Additions, subtractions, deletions and other modifications of the described embodiments are within the scope of the following claims.

What is claimed is:

1. A method for improving the fatigue characteristics of a metallic material, said method comprising the steps of:

heating said material to a temperature in a range extending from about 0.35 to 0.65 the homologous temperature of said material;

while the temperature of said material is in said range, applying a force system comprising a tensile force, a couple, or both a tensile force and a couple to said material to produce in at least the region of said material to be treated a tensile stress level not less than the yield point of said material at said temperature in said range, said force system being applied for a period of time sufficiently long to produce plastic strain in said region;

cooling said material while continuing to apply said force system to said material and maintaining said tensile stress level in said region above said yield point during at least a portion of said cooling; and removing said force system when the plastic strain in said region is not greater than about 1%, whereby the fatigue life of said material is increased by at least two-fold as compared to an untreated said material.

2. The method of claim 1 wherein said temperature is approximately 90% of the Young's Modulus Transition Temperature.

3. The method of claim 1 wherein said force system is removed when the plastic strain in said region is from about 0.05% to about 1% greater than the plastic strain in said region at the yield point.

4. A method for improving the fatigue characteristics of a metallic material, said method comprising the steps of:

heating said material to a temperature in a range extending from about 0.35 to 0.65 the homologous temperature of said material;

while the temperature of said material is in said range, applying a force system comprising a tensile force, a couple, or both a tensile force and a couple to said material to produce in at least the region of said material to be treated a tensile stress level greater than the yield point of said material at said temperature in said range, said force system being applied for a period of time sufficiently long to produce plastic strain in said region;

cooling said material while continuing to apply said force system to said material and maintaining said tensile stress level in said region above said yield point during at least a portion of said cooling; and, removing said force system when the plastic strain in said region is substantially equal to twice the plastic strain of said material at the yield point thereof, whereby the fatigue life of said material is increased by at least two-fold as compared to an untreated said material.

5. The method of claim 1 wherein said force system is removed when said plastic strain is from about 0.2% to 0.5%.

6. The method of claim 1 wherein said temperature is not less than 0.4 the homologous temperature of said material.

7. The method of claim 1 wherein said material is cooled to about 200° C. while continuing to apply said force thereto.

8. The method of claim 1 wherein said temperature is not less than 400° C.

9. The method of claim 1 wherein said force system applied to said material while said temperature is in said range produces in said region a stress level not greater than the stress corresponding at said temperature to a plastic strain that is 5% to 50% greater than the plastic strain at the yield point of said material at said temperature.

10. The method of claim 9 wherein said stress level is not greater than the stress corresponding at said temperature to a plastic strain of from about 105% to about 110% of the plastic strain at the yield point of said material at said temperature.

11. The method of claim 1 wherein said stress level is a tensile stress not greater than that corresponding to a strain of about 10% greater than the strain at the yield point of said material at said temperature.

12. The method of claim 1 wherein said material is carbon steel.

13. The method of claim 1 wherein said temperature is about 0.35 to 0.5 the homologous temperature of said material.

14. The method of claim 1 wherein said material is cooled by water spraying.

15. A method for increasing the fatigue properties of a metallic material, comprising the steps of:

heating said material to a temperature not less than about 0.3 the homologous temperature thereof;

while the temperature of said material is above said temperature, applying a force system comprising a tensile force, a couple, or both a tensile force and a couple to said material to produce in at least the region of said material to be treated a tensile stress level not less than the yield point of said material at said temperature in said range and not greater than that corresponding to a strain about 10% greater than the plastic strain at said yield point, said force system being applied for a period of time sufficiently long to produce plastic strain in said region;

cooling said material while continuing to apply said force system to said material and maintaining the tensile stress level in said region above the instantaneous yield point during at least a portion of said cooling; and ceasing to apply said force system when the retained plastic strain in said region in said cooled material is substantially equal to a plastic strain of from about 0.05% to about 1.0%, whereby the fatigue life of said material is increased by at least two-fold as compared to an untreated said material.

16. The method of claim 15 wherein said material is heated to a temperature of about 0.3 to about 0.4 the homologous temperature thereof.

17. The method of claim 15 wherein said force is ceased to be applied when the plastic strain is from about 0.2% to about 0.4%.

18. A metallic material treated in accordance with the process of claim 1.

19. A metallic material treated in accordance with the process of claim 15.

20. A method for improving the fatigue characteristics of a metallic material, said method comprising the steps of:

heating said material to a temperature in a range extending from about 0.35 to 0.65 the homologous temperature of said material;

while the temperature of said material is in said range, applying a force system comprising a tensile force, a couple, or both a tensile force and a couple to said material to produce in at least the region of said material to be treated a tensile stress level greater than the yield point of said material at said temperature in said range, said force system being applied for a period of time sufficiently long to produce plastic strain in said region;

cooling said material while continuing to apply said force system to said material and maintaining said tensile stress level in said region above said yield point during at least a portion of said cooling; and, removing said force system when the plastic strain in said region is greater than about 0.05% but has not effected any substantial reduction in the cross-section of the material, whereby the fatigue life of said material is increased by at least two-fold as compared to an untreated said material.

* * * * *